US010184269B2

(12) United States Patent
Skogstrom

(10) Patent No.: US 10,184,269 B2
(45) Date of Patent: Jan. 22, 2019

(54) CAM LOCK

(71) Applicant: ABLOY OY, Joensuu (FI)

(72) Inventor: Peter Skogstrom, Joensuu (FI)

(73) Assignee: ABLOY OY, Joensuu (FI)

( * ) Notice: Subject to any disclaimer, the term of this patent is extended or adjusted under 35 U.S.C. 154(b) by 0 days.

(21) Appl. No.: 15/758,550

(22) PCT Filed: Sep. 15, 2015

(86) PCT No.: PCT/FI2015/050615
§ 371 (c)(1),
(2) Date: Mar. 8, 2018

(87) PCT Pub. No.: WO2017/046442
PCT Pub. Date: Mar. 23, 2017

(65) Prior Publication Data

US 2018/0274263 A1 Sep. 27, 2018

(51) Int. Cl.

| | |
|---|---|
| ***E05B 11/02*** | (2006.01) |
| ***E05B 11/04*** | (2006.01) |
| ***E05C 3/02*** | (2006.01) |
| *E05B 65/02* | (2006.01) |

(52) U.S. Cl.
CPC ..... *E05B 11/02* (2013.01); *E05B 11/04* (2013.01); *E05C 3/02* (2013.01); *E05B 65/025* (2013.01)

(58) Field of Classification Search
CPC ..... E05B 11/02; E05B 11/04; E05B 65/025; E05C 3/02; E05C 3/10; E05C 3/06; E05C 3/165; E05C 3/167; E05C 3/22
USPC ..... 292/57–62, DIG. 62; 70/379 R, 379 A, 70/380, 99, 100, 389, 390, 360, DIG. 42, 70/127, 128, 130, DIG. 20, DIG. 27, 70/DIG. 36, DIG. 79
See application file for complete search history.

(56) References Cited

U.S. PATENT DOCUMENTS

| | | | | | |
|---|---|---|---|---|---|
| 1,907,625 | A * | 5/1933 | Vogt | E05B 65/0864 | 292/140 |
| 3,102,411 | A * | 9/1963 | Friedman | E05B 65/0864 | 292/62 |
| 4,907,716 | A * | 3/1990 | Wankel | E05B 35/008 | 220/326 |
| 5,076,080 | A * | 12/1991 | Fuss | E05C 3/042 | 292/66 |
| 5,152,161 | A * | 10/1992 | Lee | E05B 63/0013 | 292/212 |
| 5,907,963 | A * | 6/1999 | Myers | E05B 9/086 | 70/371 |

(Continued)

FOREIGN PATENT DOCUMENTS

| | | |
|---|---|---|
| DE | 11 65 449 B | 3/1964 |
| GB | 2 500 979 A | 10/2013 |

*Primary Examiner* — Lloyd A Gall
(74) *Attorney, Agent, or Firm* — Muncy, Geissler, Olds & Lowe, P.C.

(57) ABSTRACT

A cam lock has a lock cylinder and a cam part connected to the lock cylinder. The cam part is turnable from a lock position to an open position when turning a key placed in the lock cylinder. The cam part comprises a spring and a flange that is arranged to receive external force towards the lock cylinder. The spring allows the movement of the cam part at the open position towards the lock cylinder as response to external force. The spring is further arranged to turn the cam part towards the lock position.

10 Claims, 3 Drawing Sheets

(56) References Cited

U.S. PATENT DOCUMENTS

Figure 1:
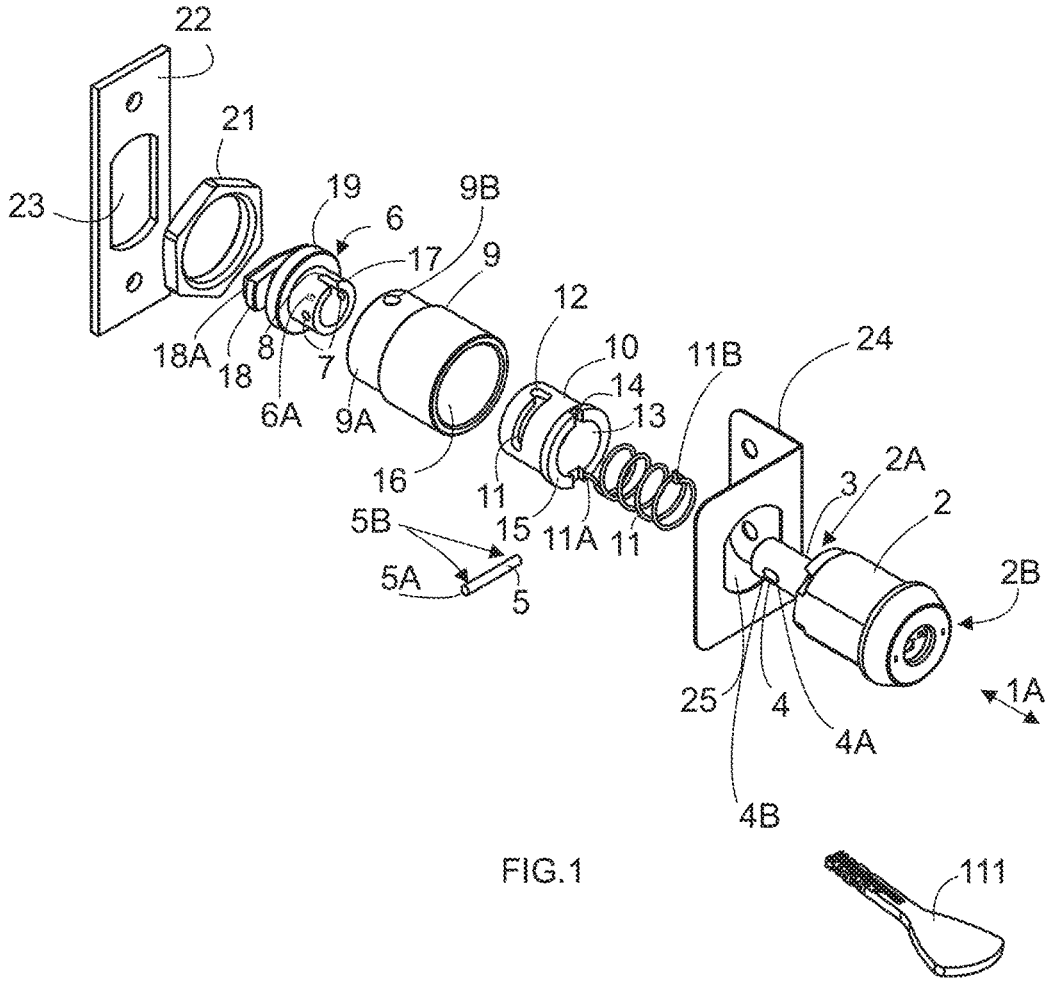

| | | | | |
|---|---|---|---|---|
| 6,640,592 | B2 * | 11/2003 | Vickers | E05B 17/04 292/64 |
| 6,920,770 | B2 * | 7/2005 | Lurie | E05B 9/086 70/100 |
| 6,978,645 | B2 * | 12/2005 | Shimon | E05B 17/0058 70/379 R |
| 7,441,427 | B2 * | 10/2008 | Vickers | E05B 17/0025 292/57 |
| 7,870,772 | B1 * | 1/2011 | Guo | E05B 13/108 292/DIG. 27 |
| 2004/0160130 | A1 | 8/2004 | Eckerdt | |
| 2004/0255627 | A1 * | 12/2004 | Shimon | E05B 17/0058 70/379 R |
| 2014/0353983 | A1 * | 12/2014 | Vetter | E05B 47/0012 292/197 |

* cited by examiner

CAM LOCK

FIELD OF TECHNOLOGY

The present invention relates to cam locks that are used to lock different cabinets, like mailboxes and lockers.

PRIOR ART

Different cabinets are often provided with a cam lock, like mailboxes, lockers in indoor swimming pools or schools etc. The cam lock is turned open by turning a key that is put into the lock cylinder of the cam lock. When the cam lock is open the key can be pulled away from the lock by turning the key first to its initial position. The initial position means in this context the position wherein the key can be put into the lock cylinder and also pulled out from the lock cylinder.

So, the key can be accidentally pulled out when the cabinet is open and then lost. For example children at school or in a gymnastic hall may play with the key and drop it. To find the dropped key among the clothes can be tedious. The cabinet, for example mailbox, can also be left open by accident, which is not desired.

DE 1165449 discloses a known cam lock having a lock cylinder and a cam part connected to the lock cylinder. The cam part is turnable from a lock position to an open position when turning a key placed in the lock cylinder.

SHORT DESCRIPTION OF INVENTION

The aim of the invention is to alleviate the problem of the prior art.

A cam lock according to the invention has a lock cylinder and a cam part connected to the lock cylinder. The cam part is turnable from a lock position to an open position when turning a key placed in the lock cylinder. The lock cylinder has a shaft on an inner end of the lock cylinder, which shaft is connected to the cam part. The connection between the shaft and the cam part allows movement of the cam part in relation to the shaft in direction of a longitudinal axis of the shaft. The cam lock further comprises an outer bush ring, inner bush ring and a spring between the lock cylinder and the cam part, and around the shaft. The outer bush ring is connected to the lock cylinder and it covers the inner push ring and the spring. The inner push ring covers the spring that is arranged to push the cam part away from the lock cylinder.

The inner bush ring is arranged to keep the cam part in a first axial position of the longitudinal axis of the shaft when the cam part is at the lock position and also arranged to allow the movement of the cam part away from the lock cylinder in the direction of the longitudinal axis of the shaft after the cam part is turned from the lock position to the open position. The cam part further comprises a flange that is arranged to receive force towards the lock cylinder in the direction of the longitudinal axis of the shaft. The force can be the force that is used to close the cabinets door in which case a striking plate hits to the flange. The spring allows the movement of the cam part at the open position towards the first axial position as response to said force. The spring is further arranged to turn the cam part at the first axial position towards the lock position.

Since the key put in to the lock cylinder is in its initial position when the cam part is at the lock position, the key cannot be taken away from the cam lock when the cam part is at the open position. At the open position the cam part is not at the first axial position of the longitudinal axis of the shaft due to the spring. When the cam is at the first axial position the spring turns the cam part towards the lock position. The key can be taken away from the lock when the cam part is at the lock position which is the case when the door of the cabinet is pushed closed.

LIST OF FIGURES

Figure 2:
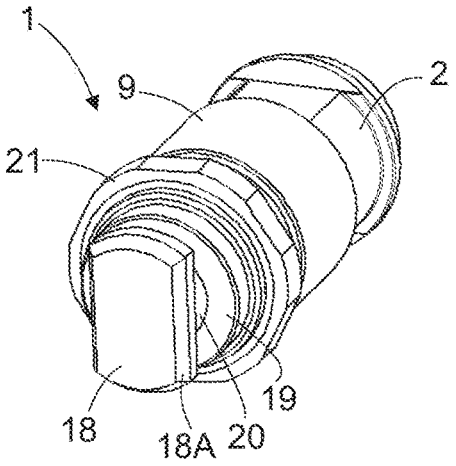
Figure 3:
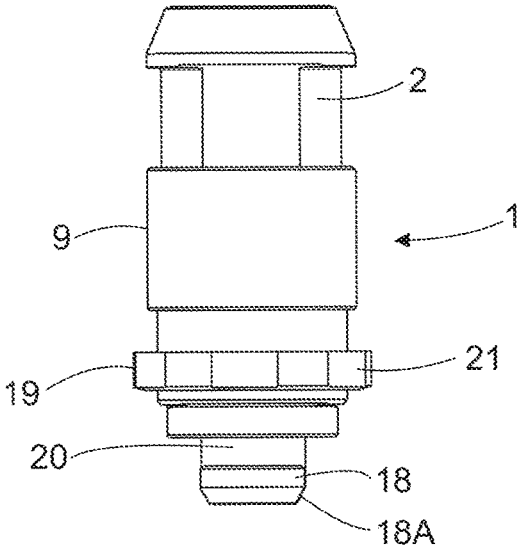
Figure 4:
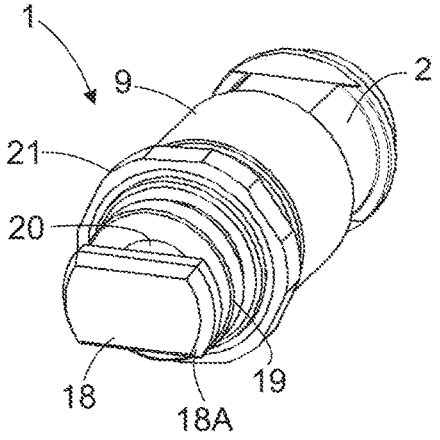
Figure 5:
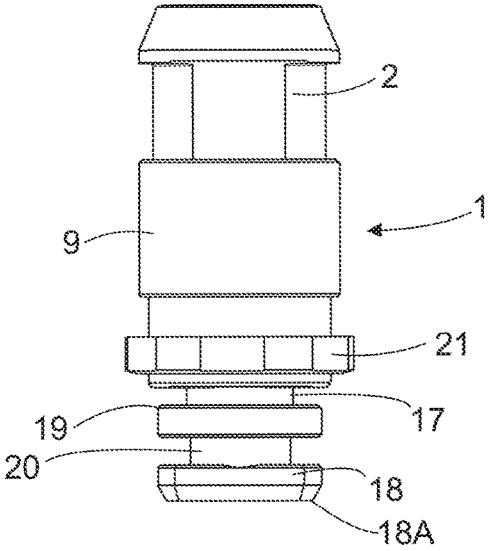

In the following, the invention is described in more detail by reference to the enclosed drawings, where FIG. 1 illustrates an example of the invention as an exploded view, FIG. 2 illustrates an example of the invention at lock position, FIG. 3 illustrates the lock position of FIG. 2 from another view, FIG. 4 illustrates an example of the invention at open position, and FIG. 5 illustrates the open position of FIG. 4 from another view.

DESCRIPTION OF THE INVENTION

FIG. 1 illustrates an example of an exploded view of the inventive cam lock. The cam lock has a lock cylinder 2 and a cam part 6 connected to the lock cylinder. The cam part 6 is turnable from a lock position to an open position when turning a key 111 placed in the lock cylinder. As can be seen the key hole of the cylinder is on an outer end 2B of the lock cylinder. The lock cylinder 2 has a shaft 3 on an inner end 2A of the lock cylinder 2, which shaft 3 is connected to the cam part 6. The connection between the shaft 3 and the cam part 6 allows movement of the cam part 6 in relation to the shaft 3 in direction 1A of a longitudinal axis of the shaft 3.

The cam lock further comprises an outer bush ring 9, inner bush ring 10 and a spring 11 between the lock cylinder 2 and the cam part 6 and around the shaft 3. The outer bush ring 9 is connected to the lock cylinder 2 and it also covers the inner bush ring 10 and the spring 11. The inner bush ring 10 covers the spring 11 being arranged to push the cam part 6 away from the lock cylinder 2.

The inner bush ring 10 is arranged to keep the cam part 6 in a first axial position of the longitudinal axis of the shaft 3 when the cam part 6 is at the lock position and also arranged to allow the movement of the cam part 6 away from the lock cylinder 2 in the direction of the longitudinal axis of the shaft 3 after turning the cam part 6 from the lock position to the open position.

FIG. 1 illustrates also a striking plate 22 having a hole for the cam 18 of the cam part 6. If thought that the striking plate is at correct position in this example, the cam part is then at the lock position, because the cam 18 grip to the striking plate and cannot be moved freely through the hole 23 of the striking plate. If the cam part 6 were turned 90 degrees in relation to axis 1A and the position showed in FIG. 1, the cam part would be at the open position when the cam part can be moved freely through the hole 23 of the striking plate. The striking plate is installed, for example, in a frame of a cabinet. FIG. 1 shows also a possible support plate 24 that can be installed in a door of the cabinet. The support plate is provided with a hole 25 for the cam lock. A nut 21 is used when the cam lock is installed, for example, in the door of the cabinet.

The cam part 6 further comprises a flange 19 that is arranged to receive force towards the lock cylinder 2 in the direction of the longitudinal axis of the shaft 3. When the door of the cabinet, like mailbox or locker, is pushed closed, the flange hits to the striking plate 22 (or a frame structure in case the striking plate is not used). It should be keep in mind that when closing the door the cam part 6 is at open position when it can be moved freely through the hole 23 of the striking plate. The free movement through the hole means in this context that the cam 18 and the neck 20 (see FIGS. 3 and 5) of the cam part can be moved through the hole. So, a part of the force pushing the door is received by the flange. Because the force is towards the lock cylinder the cam part moves towards the cylinder 2. This is due because the spring 11 allows the movement of the cam part 6 at the open position towards the first axial position as response to said force. The spring 11 is further arranged to turn the cam part 6 at the first axial position towards the lock position.

FIGS. 2 and 3 showing the lock position of the cam part 6 and FIGS. 4 and 5 showing the open position of the cam part 6 illustrate an example of the inventive embodiment of the cam lock. The neck part 20 of the cam part and the cam 18 can be seen clearly in FIGS. 3 and 5. The neck is between the cam 18 and the flange 19. As showed in FIG. 1, the cam part 6 comprises also a stub end 17 towards the lock cylinder 2. The stub end comprises a projection connection. The projection connection can, for example, be an integral pin 6A on the stub end or the end of a separate pin 5 that is described in more detail below.

The inner bush ring 10 has a slot 11 in transversal direction in relation to the longitudinal axis of the shaft 3, and the slot 11 has a slot part 12 at another end of the slot 11 in the longitudinal direction 1A of the shaft 3. The projection connection is arranged to be in the slot 11, 12. The slot keeps the cam part 6 in the first axial position of the longitudinal axis of the shaft 3 when the cam part 6 is at the lock position. In addition, it can be noted that the slot keeps the cam part in the first axial position during the turning of the cam part from the lock position to the open position or turning the cam part from the open position to the lock position.

The slot part 12 of the slot 11 allows the movement of the cam part 6 away from the lock cylinder 2 in the direction of a longitudinal axis of the shaft 3 after turning the cam part 6 from the lock position to the open position. So when the cam part 6 is at the open position the spring pushes it from the first axial position. If no external force towards the lock cylinder is received by the cam part 6, the cam part 6 remains to be away from the first axial position, and at the open position wherein the key cannot be pulled away from the lock cylinder 2. The cam part can be moved back to the first axial position by external force. The spring 11 turns the cam part 6 at the first axial position towards the lock position.

The shaft 3 has a through hole 4 with a longitudinal shape in the longitudinal direction of the shaft 3. The cam lock further comprises a pin 5 being positioned through the through hole 4 and connected to the stub end 17 providing said connection between the shaft 3 and the cam part 6. The longitudinal shape of the hole allows the movement of the cam part in the axial direction 1A. When the cam part is at the first axial position, the pin 5 is at the first end 4A of the longitudinal shape of the hole 4, and when the cam part is not at the first axial position (the projection connection in the slot part 12) and at open position, the pin 5 is at the second end 4B of the longitudinal shape of the hole 4.

The stub end 17 may have holes 7 for end parts of the pin 5 providing said connection between the shaft 3 and the cam part 6. In this embodiment at least one end of the pin 5 provides said projection connection.

In addition as showed in FIG. 1, the stub end 17 can have a groove 8 for a first end 11A of the spring 11, and the inner bush ring 10 can have at least one position groove 14 for a second end 11B of the spring 11. The position groove 14 may also provide a connection between the lock cylinder 2 and the inner bush ring 10 or between the outer bush ring 9 and the inner bush ring 10. Both the outer and inner bush rings are arranged to keep their rotational position with respect to the lock cylinder. The outer bush ring 9 may also have an installation hole 9B.

As can be seen in the embodiment of the figures the cam 18 has longitudinal shape, and the cam is in connection with the neck 20 at a central part to the cam providing two projections on opposite sides of the neck. The cam can however be a one-side cam having one projection on one side of the neck. The cam may also have sloped edges 18A on a side away from the neck 20.

As showed in the figures the outer ring 9 can be designed to have a thinner part 9A at the end towards the cam part 6. The larger part of the outer ring is used to fix it with the lock cylinder, for example utilizing threads (not showed in the figures). The inner bush ring 10 is situated into the hole 16 of the outer bush ring, and the spring is situated into the hole 13 of the inner bush ring 10. The inner bush ring may also have a flange 15 that is used for connecting the inner bush ring into the outer bush ring.

As described above the key can be taken away from the lock when the cam part is at the lock position, which is the case when the door of the cabinet is pushed closed. Therefore the key cannot be taken away from the cam lock by accident.

It is evident from the above that the invention is not limited to the embodiments described in this text but can be implemented in many other different embodiments within the scope of the independent claim.

The invention claimed is:

1. A cam lock having a lock cylinder and a cam part connected to the lock cylinder, the cam part being turnable from a lock position to an open position when turning a key placed in the lock cylinder, wherein lock cylinder has a shaft on an inner end of the lock cylinder, which shaft is connected to the cam part, the connection between the shaft and the cam part allowing movement of the cam part in relation to the shaft in a direction of a longitudinal axis of the shaft, the cam lock further comprising an outer bush ring, inner bush ring and a spring between the lock cylinder and the cam part and around the shaft, the outer bush ring being connected to the lock cylinder and covering the inner bush ring and the spring, the inner bush ring covering the spring being arranged to push the cam part away from the lock cylinder, the inner bush ring being arranged to keep the cam part in a first axial position of the longitudinal axis of the shaft when the cam part is at the lock position and being arranged to allow the movement of the cam part away from the lock cylinder in the direction of the longitudinal axis of the shaft after turning the cam part from the lock position to the open position, the cam part further comprising a flange being arranged to receive force towards the lock cylinder in the direction of the longitudinal axis of the shaft, and said spring allowing the movement of the cam part at the open position towards the first axial position in response to said force, and the spring being further arranged to turn the cam part at the first axial position towards the lock position.

2. A cam lock according to claim 1, wherein the cam part comprises a neck and a cam, the neck being between the cam and the flange.

3. A cam lock according to claim 2, wherein the cam part comprises a stub end towards the lock cylinder, the stub end comprising a projection connection, and the inner bush ring having a slot in transversal direction in relation to the longitudinal axis of the shaft, and the slot having a slot part at another end of the slot in the longitudinal direction of the shaft, the projection connection being arranged to be in the slot, which slot restricts the cam part to be in the first axial position of the longitudinal axis of the shaft when the cam part is at the lock position, and which slot part allows the movement of the cam part away from the lock cylinder in the direction of a longitudinal axis of the shaft after turning the cam part from the lock position to the open position.

4. A cam lock according to claim 1, wherein the shaft has a through hole with a longitudinal shape in the longitudinal direction of the shaft, the cam lock further comprising a pin being positioned through the through hole and connected to a stub end providing said connection between the shaft and the cam part.

5. A cam lock according to claim 3, wherein the shaft has a through hole with a longitudinal shape in the longitudinal direction of the shaft, the cam lock further comprising a pin being positioned through the through hole and connected to the stub end having holes for end parts of the pin providing said connection between the shaft and the cam part, at least one end of the pin providing said projection connection.

6. A cam lock according to claim 4, wherein the stub end has a groove for a first end of the spring, and the inner bush ring has at least one position groove for a second end of the spring.

7. A cam lock according to claim 6, wherein the position groove provides a connection between the lock cylinder and the inner bush ring or between the outer bush ring and the inner bush ring.

8. A cam lock according to claim 2, wherein the cam has a longitudinal shape, and the cam is in connection with the neck at a central part to the cam providing two projections on opposite sides of the neck.

9. A cam lock according to claim 2, wherein the cam has sloped edges on a side away from the neck.

10. A cam lock according to claim 1, wherein the outer bush ring has an installation hole.

* * * * *